US006044732A

United States Patent [19]

Astle

[11] Patent Number: 6,044,732

[45] Date of Patent: Apr. 4, 2000

[54] PLUMBING TOOL

[76] Inventor: Daniel K Astle, 7345 Granola Way, Citrus Heights, Calif. 95621

[21] Appl. No.: 09/156,090

[22] Filed: Sep. 17, 1998

[51] Int. Cl.[7] ..... B25B 13/48

[52] U.S. Cl. ..... 81/176.15; 81/124.2; 81/177.5

[58] Field of Search ..... 81/176.1, 176.15, 81/119, 121.1, 124.2, 177.5

[56] References Cited

U.S. PATENT DOCUMENTS

| | | | |
|---|---|---|---|
| 845,717 | 2/1907 | Miller | 81/121.1 |
| 1,397,876 | 11/1921 | Meldal | 81/176.15 |
| 1,972,239 | 9/1934 | Rose | 81/124.2 |
| 2,544,058 | 3/1951 | Watkins | 81/176.15 |
| 2,619,861 | 12/1952 | Wanamaker | 81/176.15 |
| 2,956,461 | 10/1960 | Anderson | 81/176.15 |
| 4,357,845 | 11/1982 | Cornia | 81/124.2 |
| 5,048,378 | 9/1991 | Nikolas | 81/124.2 |
| 5,542,321 | 8/1996 | Fuca | 81/124.2 |
| 5,697,268 | 12/1997 | Makovsky et al. | 81/176.15 |

FOREIGN PATENT DOCUMENTS

| | | | |
|---|---|---|---|
| 323814 | 7/1989 | European Pat. Off. | 81/176.15 |

*Primary Examiner*—David A. Scherbel
*Assistant Examiner*—Joni B. Danganan

[57] ABSTRACT

A plumbing tool for tightening the drain assembly of a shower. The tool includes a shaft having opposite proximal and distal ends and a tubular first bell reducer having open proximal and distal ends. The distal end of the shaft is inserted into the proximal end of the first bell reducer. A tubular second bell reducer is provided having open proximal and distal ends. The distal end of the first bell reducer is inserted into the proximal end of the second bell reducer. The distal end of the second bell reducer has therearound a plurality of spaced apart notches to define a plurality of spaced apart teeth around the distal end of the second bell reducer.

8 Claims, 2 Drawing Sheets

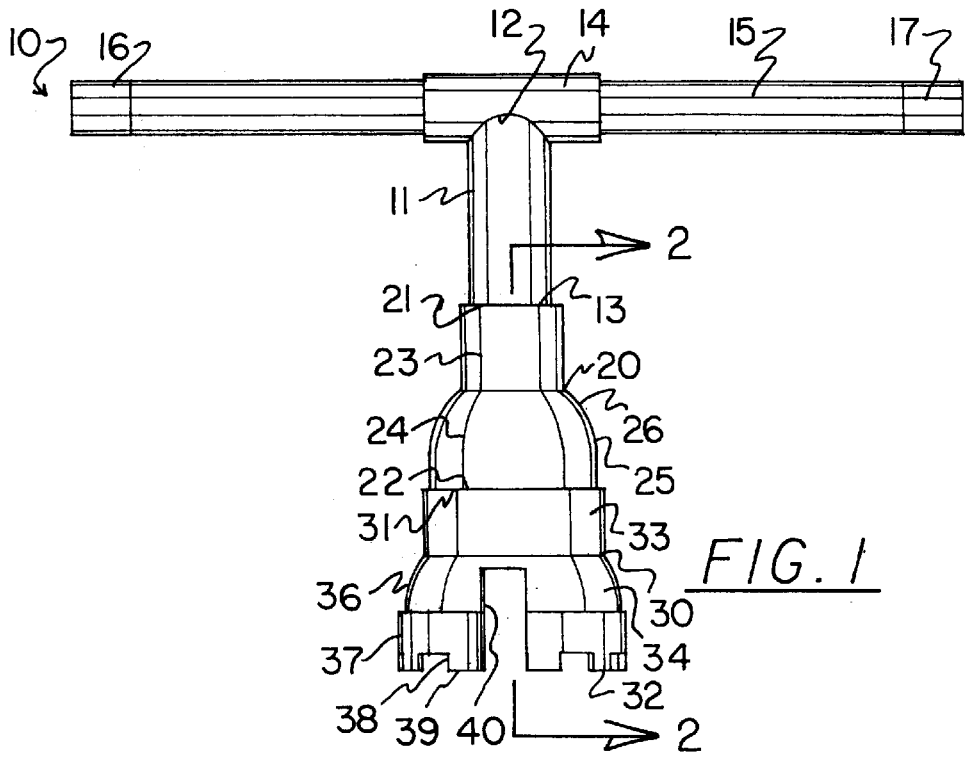
FIG. 1
FIG. 2
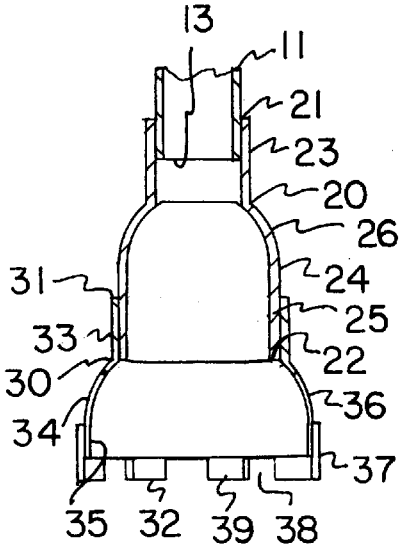

PLUMBING TOOL

BACKGROUND OF THE INVENTION

1. Field of the Invention

The present invention relates to tools and more particularly pertains to a new plumbing tool for tightening the drain assembly of a shower.

2. Description of the Prior Art

The use of tools is known in the prior art. More specifically, tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,103,698; U.S. Pat. No. 4,601,077; U.S. Pat. No. 5,320,003; U.S. Pat. No. Des. 382,788; U.S. Pat. No. 3,302,672; and U.S. Pat. No. 3,555,583.

After installing a shower, a plumber fills the shower with water to check for leaks. If a leak is found between the drain and the drain pipe, the caulking sealing ring at the union of the drain and the drain pipe must be tightened to stop the leak by tightening a brass ring which in turn tightens the caulking ring to seal the leak. This is very difficult (and time consuming) to do with traditional plumbing tools because the tool must extend past the grating of the drain without disassembling the shower or having to cut through the floor of the shower.

While these devices fulfill their respective, particular objectives and requirements, the aforementioned patents do not disclose a new plumbing tool. The inventive device includes a shaft having opposite proximal and distal ends and a tubular first bell reducer having open proximal and distal ends. The distal end of the shaft is inserted into the proximal end of the first bell reducer. A tubular second bell reducer is provided having open proximal and distal ends. The distal end of the first bell reducer is inserted into the proximal end of the second bell reducer. The distal end of the second bell reducer has therearound a plurality of spaced apart notches to define a plurality of spaced apart teeth around the distal end of the second bell reducer.

In these respects, the plumbing tool according to the present invention substantially departs from the conventional concepts and designs of the prior art, and in so doing provides an apparatus primarily developed for the purpose of tightening the drain assembly of a shower.

SUMMARY OF THE INVENTION

In view of the foregoing disadvantages inherent in the known types of tools now present in the prior art, the present invention provides a new plumbing tool construction wherein the same can be utilized for tightening the drain assembly of a shower.

The general purpose of the present invention, which will be described subsequently in greater detail, is to provide a new plumbing tool apparatus and method which has many of the advantages of the tools mentioned heretofore and many novel features that result in a new plumbing tool which is not anticipated, rendered obvious, suggested, or even implied by any of the prior art tools, either alone or in any combination thereof.

To attain this, the present invention generally comprises a shaft having opposite proximal and distal ends and a tubular first bell reducer having open proximal and distal ends. The distal end of the shaft is inserted into the proximal end of the first bell reducer. A tubular second bell reducer is provided having open proximal and distal ends. The distal end of the first bell reducer is inserted into the proximal end of the second bell reducer. The distal end of the second bell reducer has therearound a plurality of spaced apart notches to define a plurality of spaced apart teeth around the distal end of the second bell reducer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plumbing tool apparatus and method which has many of the advantages of the tools mentioned heretofore and many novel features that result in a new plumbing tool which is not anticipated, rendered obvious, suggested, or even implied by any of the prior art tools, either alone or in any combination thereof.

It is another object of the present invention to provide a new plumbing tool which may be easily and efficiently manufactured and marketed.

It is a further object of the present invention to provide a new plumbing tool which is of a durable and reliable construction.

An even further object of the present invention is to provide a new plumbing tool which is susceptible of a low cost of manufacture with regard to both materials and labor, and which accordingly is then susceptible of low prices of sale to the consuming public, thereby making such plumbing tool economically available to the buying public.

Still yet another object of the present invention is to provide a new plumbing tool which provides in the apparatuses and methods of the prior art some of the advantages thereof, while simultaneously overcoming some of the disadvantages normally associated therewith.

Still another object of the present invention is to provide a new plumbing tool for tightening the drain assembly of a shower.

Yet another object of the present invention is to provide a new plumbing tool which includes a shaft having opposite proximal and distal ends and a tubular first bell reducer having open proximal and distal ends. The distal end of the shaft is inserted into the proximal end of the first bell reducer. A tubular second bell reducer is provided having open proximal and distal ends. The distal end of the first bell reducer is inserted into the proximal end of the second bell reducer. The distal end of the second bell reducer has therearound a plurality of spaced apart notches to define a plurality of spaced apart teeth around the distal end of the second bell reducer.

Still yet another object of the present invention is to provide a new plumbing tool that allows a plumber to quickly and easily tighten the caulking ring around the union of the drain and drain pipe of a shower to stop any leaks from the union.

Even still another object of the present invention is to provide a new plumbing tool that allows a plumber to tighten a drain of a shower without damaging the floor of the shower by cutting through the shower.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new plumbing tool according to the present invention.

FIG. 2 is a schematic cross sectional view of the present invention taken from line 2—2 of FIG. 1.

DESCRIPTION OF THE PREFERRED EMBODIMENT

Figure 3:
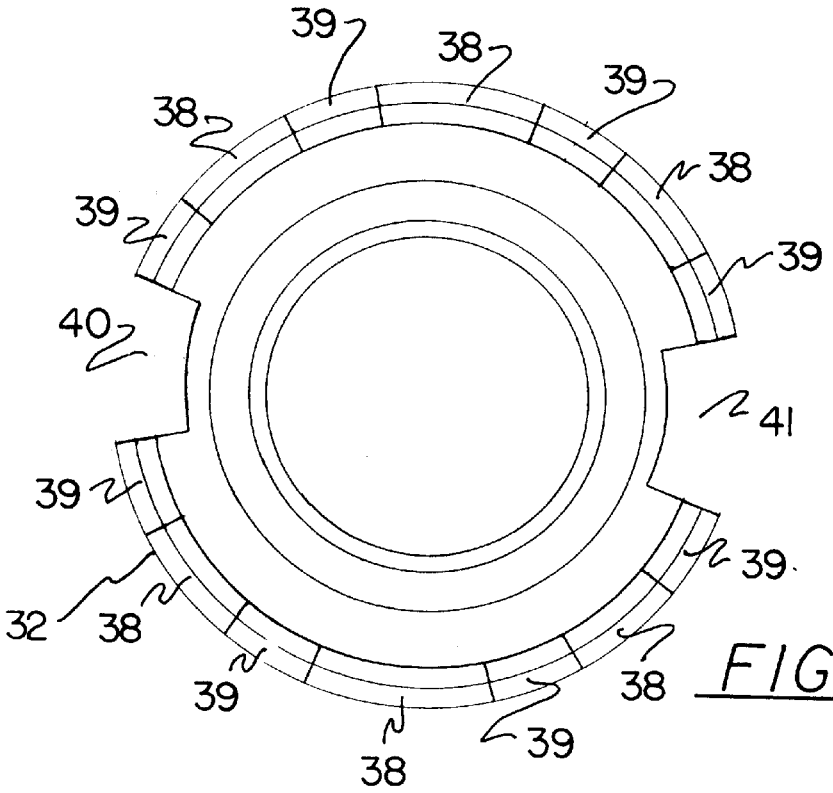
FIG. 3 is a schematic distal end view of the present invention.

With reference now to the drawings, and in particular to FIGS. 1 through 4 thereof, a new plumbing tool embodying the principles and concepts of the present invention and generally designated by the reference numeral 10 will be described.

As best illustrated in FIGS. 1 through 4, the plumbing tool 10 generally comprises a shaft 11 having opposite proximal and distal ends 12,13 and a tubular first bell reducer 20 having open proximal and distal ends 21,22. The distal end 13 of the shaft 11 is inserted into the proximal end 21 of the first bell reducer 20. A tubular second bell reducer 30 is provided having open proximal and distal ends 31,32. The distal end 22 of the first bell reducer 20 is inserted into the proximal end 31 of the second bell reducer 30. The distal end 32 of the second bell reducer 30 has therearound a plurality of spaced apart notches 38 to define a plurality of spaced apart teeth 39 around the distal end 32 of the second bell reducer 30.

After installing a shower, a plumber fills the shower with water to check for leaks. If a leak is found between the drain and the drain pipe, the caulking sealing ring at the union of the drain and the drain pipe must be tightened to stop the leak by tightening a brass ring which in turn tightens the caulking ring to seal the leak. The plumbing tool 10 is designed for quickly and easily tightening the caulking ring of the drain assembly of a shower to stop water leaks from the drain assembly.

Figure 4:
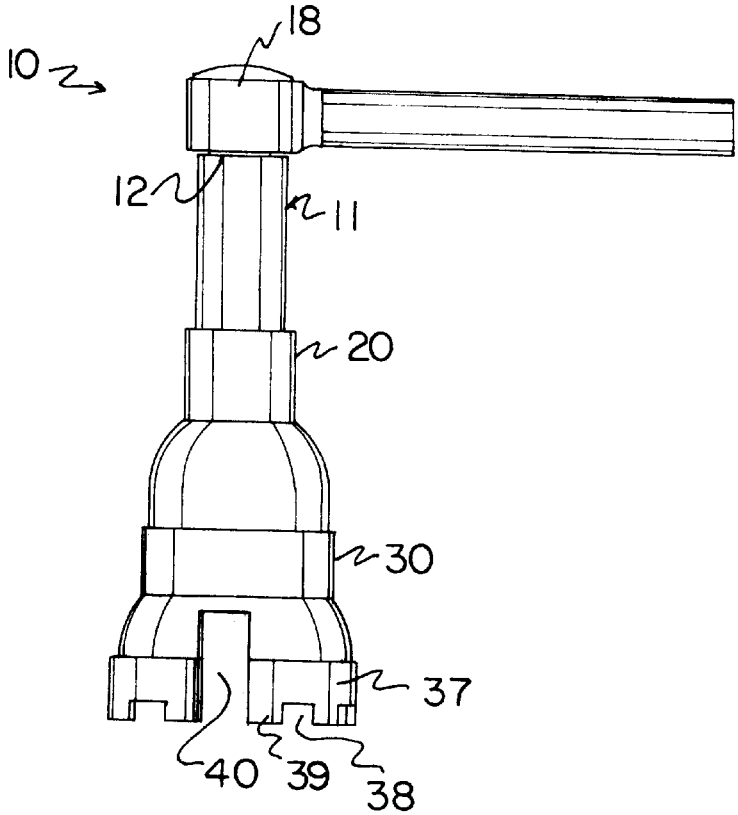
FIG. 4 is a schematic side view of an embodiment of the present invention adapted for attachment to a ratchet handle.

Specifically, the shaft 11 of the plumbing tool is tubular and has opposite proximal and distal ends 12,13. The shaft 11 is generally cylindrical and has a longitudinal axis extending between the proximal and distal ends 12,13 of the shaft 11, a diameter, and a length defined between the proximal and distal ends 12,13 of the shaft 11. The proximal end 12 of the shaft 11 has a tubular mounting portion 14 which is generally cylindrical and has an axis extending generally perpendicular to the longitudinal axis of the shaft 11. An elongate handle rod 15 is extended through the mounting portion 14 of the shaft 11. The handle rod 15 is generally cylindrical and has a pair of opposite ends, a diameter, and a length defined between the ends of the handle rod 15. Each of the ends of the handle rod 15 preferably has an end cap 16,17 thereon. Optionally as illustrated in FIG. 4, the proximal end 12 of the shaft 11 may be adapted for attachment to a ratchet handle 18 instead of the handle rod and mounting portion configuration.

The tubular first bell reducer 20 has open proximal and distal ends 21,22, proximal and distal portions 23,24, and a longitudinal axis extending between the proximal and distal ends 21,22 of the of first bell reducer 20 through the proximal and distal portions 23,24 of the first bell reducer 20. The proximal and distal ends 21,22 of the first bell reducer 20 are each generally circular and have a diameter. The diameter of the proximal end 21 of the first bell reducer 20 is less than the diameter of the distal end 22 of the first bell reducer 20. The proximal and distal portions 23,24 of the first bell reducer 20 each have'a length defined along the longitudinal axis of the first bell reducer 20. The distal portion 24 of the first bell reducer 20 has a straight side wall region 25 and an arcuate side wall region 26. The straight side wall region 25 of the distal portion 24 of the first bell reducer 20 is positioned adjacent the distal end 22 of the first bell reducer 20. The arcuate side wall region 26 of the distal portion 24 of first bell reducer 20 is positioned adjacent the proximal portion 23 of the first bell reducer 20. The distal end 13 of the shaft 11 is inserted into the proximal end 21 of the first bell reducer 20 to couple against rotation the shaft 11 to the first bell reducer 20 such that the longitudinal axes of the shaft 11 and first bell reducer 20 are generally coaxial.

The tubular second bell reducer 30 has open proximal and distal ends 31,32, proximal and distal portions 33,34, and a longitudinal axis extending between the proximal and distal ends 31,32 of the of second bell reducer 30 through the proximal and distal portions 33,34 of the second bell reducer 30. The proximal and distal ends 31,32 of the second bell reducer 30 each are generally circular and have a diameter. The diameter of the proximal end 31 of the second bell reducer 30 is less than the diameter of the distal end 32 of the second bell reducer 30. The proximal and distal portions 33,34 of the second bell reducer 30 each have a length defined along the longitudinal axis of the second bell reducer 30. The distal portion 34 of the second bell reducer 30 has a straight side wall region 35 and an arcuate side wall region 36. The straight side wall region 35 of the distal portion 34 of the second bell reducer 30 is positioned adjacent the distal end 32 of the second bell reducer 30. The arcuate side wall region 36 of the distal portion 34 of second bell reducer 30 is positioned adjacent the proximal portion 33 of the second bell reducer 30. The distal end 22 of the first bell reducer 20 is inserted into the proximal end 31 of the second bell reducer 30 to couple against rotation the first bell reducer 20 to the second bell reducer 30 such that the longitudinal axes of the first bell reducer 20 and the second bell reducer 30 are generally coaxial.

In use, the distal end 32 of the second bell reducer 30 is designed for inserting into a drain of a shower to engage the caulking ring. The second bell reducer 30 has an annular half coupling 37 extending around the straight side wall region 35 of the distal portion 34 of the second bell reducer 30 adjacent the distal end 32 of the second bell reducer 30. The half coupling 37 is coupled against rotating to the second bell reducer 30. In use, the half coupling 37 is designed for providing the proper thickness to the distal end 32 of the second bell reducer 30 and for increased strength and durability to the distal end 32 of the second bell reducer 30.

The distal end 32 of the second bell reducer 30 has therearound a plurality of spaced apart notches 38 through the straight side wall region 35 of the distal portion 34 of the second bell reducer 30 and the half coupling 37 to define a plurality of spaced apart teeth 39 around the distal end 32 of the second bell reducer 30. The teeth 39 are preferably spaced apart at generally equal intervals around the distal end 32 of the second bell reducer 30. In use, the teeth 39 are designed for engaging the brass ring of a caulking ring at the union of the drain and drain pipe to tighten the caulking ring to seal the union. The notches 38 each preferably have a generally rectangular configuration such that each of the teeth 39 has a generally rectangular configuration. Each of the notches 38 has a depth defined in a direction parallel to the longitudinal axis of the second bell reducer 30, and a width defined between the adjacent teeth 39. Each of the teeth 39 has a length defined in a direction parallel to the longitudinal axis of the second bell reducer 30, and a width defined between the adjacent notches 38.

The plurality of notches 38 also includes a pair of diametric notches 40,41 on the distal end 32 of the second bell reducer 30. Each of the notches 40,41 of the pair of diametric notches has a depth greater than the depth of the remainder of the notches 38 of the plurality of notches 38. Preferably, the depths of the pair of diametric notches 40,41 are generally equal to one another while the depths of the remainder of the notches 38 of the plurality of notches 38 are generally equal to one another. In use, the diametric pair of notches 40,41 are designed for receiving the grate of the drain of the shower therein when the distal end 32 of the second bell reducer 30 is inserted into the drain.

In an ideal illustrative embodiment, designed in particular for fitting drains of showers manufactured by Oatey Casper under the name "Hot Mop", the diameter of the shaft 11 is about 1 inch and the length of the shaft 11 is about 2 inches. The diameter of the handle rod 15 is about ¾ inch and the length of the handle rod 15 is about 11 inches. In this ideal illustrative embodiment, the diameter of the proximal end 21 of the first bell reducer 20 is about 1 inch and the diameter of the distal end 22 of the first bell reducer 20 is about 2 inches. The length of the proximal portion 23 of the first bell reducer 20 is ideally about 1 inch and the length of the distal portion 24 of the first bell reducer 20 is about 2 inches. The diameter of the proximal end 31 of the second bell reducer 30 is about 2 inches while the diameter of the distal end 34 of the second bell reducer is ideally about 2½ inches. Also in this ideal embodiment, the length of the second bell reducer 30 is defined between the proximal and distal ends of the second bell reducer 30 of about 1½ inches. The half coupling 37 has ideally a diameter of about 2½ inches. Ideally, the width of each notch 38 is about ⅝ inch and the length of each tooth is about ⅜ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plumbing tool, comprising:

a shaft having opposite proximal and distal ends;

a tubular first bell reducer having open proximal and distal ends;

said distal end of said shaft being inserted into said proximial end of said first bell reducer;

a tubular second bell reducer having open proximal and distal ends;

said distal end of said first bell reducer being inserted into said proximal end of said second bell reducer;

said distal end of said second bell reducer having therearound a plurality of spaced apart notches to define a plurality of spaced apart teeth around said distal end of said second bell reducer;

said first bell reducer having a distal portion with a straight side wall region and an arcuate side wall region;

said arcuate side wall region of said first bell reducer having an inwardly facing concave inner face and an outwardly facing convex outer face;

said concave inner face and said convex outer face of said first bell reducer having coaxial radii of curvatures;

said second bell reducer having a distal portion with a straight side wall region and an arcutate side wall region;

said arcuate side wall region of said second bell reducer having an inwardly facing concave inner face and an outwardly facing convex outer face; and said concave inner face and said convex outer face of said second bell reducer having coaxial radii of curvatures;

each of said notches having a depth defined in a direction parallel to said longitudinal axis of said second bell reducer, and a width defined between the adjacent teeth;

each of said teeth having an outwardly facing distal edge, said distal edges of said teeth lying in a common plane with one another;

each of said teeth having a length defined in a direction parallel to said longitudinal axis of said second bell reducer, and a width defined between the adjacent notches; and said plurality of notches including a single pair of diametric notches on said distal end of said second bell reducer, each of said notches of said pair of diametric notches having a depth greater than the depth of the remainder notches of said plurality of notches, wherein said depths of each notch of said pair of diametric notches are generally equal to one another, wherein the depths of the remainder notches of the plurality of notches are generally equal to one another.

2. The plumbing tool of claim 1, wherein said shaft is tubular, wherein said shaft is generally cylindrical and has a longitudinal axis extending between said proximal and distal ends of said shaft, a diameter, and a length defined between said proximal and distal ends of said shaft.

3. The plumbing tool of claim 2, wherein said proximal end of said shaft has a tubular mounting portion being generally cylindrical and having an axis extending generally perpendicular to said longitudinal axis of said shaft, and wherein an elongate handle rod is extended through said mounting portion of said shaft.

4. The plumbing tool of claim 2, wherein said proximal end of said shaft is adapted for attachment to a ratchet.

5. The plumbing tool of claim 1, wherein said second bell reducer has an annular half coupling extending therearound adjacent said distal end of said second bell reducer, said notches and teeth being formed on said annular half coupling.

6. The plumbing tool of claim 1, wherein said teeth are spaced apart at generally equal intervals around said distal end of said second bell reducer.

7. The plumbing tool of claim 1, wherein said notches each have generally rectangular configuration such that each of said teeth has a generally rectangular configuration.

8. A plumbing tool, comprising:

shaft being tubular and having opposite proximal and distal ends, said shaft being generally cylindrical and having a longitudinal axis extending between said proximal and distal ends of said shaft, a diameter, and a length defined between said proximal and distal ends of said shaft;

said proximal end of said shaft having a tubular mounting portion being generally cylindrical and having an axis extending generally perpendicular to said longitudinal axis of said shaft;

an elongate handle rod being extended through said mounting portion of said shaft, said handle rod being generally cylindrical and having a pair of opposite ends, a diameters and a length defined between said ends of said handle rod;

each of said ends of said handle rod having an end cap thereon;

a tubular first bell reducer having open proximial and distal ends, proximal and distal portions, and a longitudinal axis extending between said proximal and distal ends of said of first bell reducer through said proximal and distal portions of said first belt reducer;

said proximal and distal ends of said first bell reducer each being generally circular and having a diameter, said diameter of said proximal end of said first bell reducer being less than said diameter of said distal end of said first bell reducer;

said proximal and distal portions of said first bell reducer each having a length defined along said longitudinal axis of said first bell reducer;

said distal portion of said first bell reducer having a straight side wall region and an arcuate side wall region, said straight side wall region of said distal portion of said first bell reducer being positioned adjacent said distal end of said first bell reducer, said arcuate side wall region of said distal portion of first bell reducer being positioned adjacent said proximal portion of said first bell reducer;

said arcuate side wall region of said first bell reducer having an inwardly facing concave inner face and an outwardly facing convex outer face;

said concave inner face and said convex outer face of said first bell reducer having coaxial radii of curvatures;

said distal end of said shaft being inserted into said proximal end of said first bell reducer to couple against rotation said shaft to said first bell reducer such that said longitudinal axes of said shaft and first bell reducer are generally coaxial;

a tubular second bell reducer having open proximal and distal ends, proximal and distal portions, and a longitudinal axis extending between said proximal and distal ends of said of second bell reducer through said proximal and distal portions of said second bell reducer;

said proximal and distal ends of said second bell reducer each being generally circular and having a diameter, said diameter of said proximal end of said second bell reducer being less than said diameter of said distal end of said second bell reducer;

said proximal and distal portions of said second bell reducer each having a length defined along said longitudinal axis of said second bell reducer;

said distal portion of said second bell reducer having a straight side wall region and an arcuate side wall region, said straight side wall region of said distal portion of said second bell reducer being positioned adjacent said distal end of said second bell reducer, said arcuate side wall region of said distal portion of second bell reducer being positioned adjacent said proximal portion of said second bell reducer;

said arcuate side wall region of said second bell reducer having an inwardly facing concave inner face and an outwardly facing convex outer face;

said concave inner face and said convex outer face of said second bell reducer having coaxial radii of curvatures;

said distal end of said first bell reducer being inserted into said proximal end of said second bell reducer to couple against rotation said first bell reducer to said second bell reducer such that said longitudinal axes of said first bell reducer and said second bell reducer are generally coaxial;

said second bell reducer having an annular half coupling extending around said straight side wall region of said distal portion of said second bell reducer adjacent said distal end of said second bell reducer, said half coupling being coupled to said second bell reducer;

said distal end of said second bell reducer having therearound a plurality of spaced apart notches through said straight side wall region of said distal portion of said second bell reducer and said half coupling to define a plurality of spaced apart teeth around said distal end of said second bell reducer, said teeth being spaced apart at generally equal intervals around said distal end of said second bell reducer;

said notches each having generally rectangular configuration such that each of said teeth has a generally rectangular configuration;

each of said notches having a depth defined in a direction parallel to said longitudinal axis of said second bell reducer, and a width defined between the adjacent teeth;

each of said teeth having an outwardly facing distal edge, slid distal edges of said teeth lying in a common plane with one another;

each of said teeth having a length defined in a direction parallel to said lonigitudinal axis of said second bell reducer, and a width defined between the adjacent notches; and said plurality of notches including a pair of diametric notches on said distal end of said second bell reducer, each of said notches of said pair of diametric notches having a depth greater than the depth of the remainder notches of said plurality of notches, wherein said depths of each notch of said pair of diametric notches are generally equal to one another, wherein the depths of the remainder notches of the plurality of notches are generally equal to one another.

* * * * *